US011131524B1

(12) United States Patent
Kempf et al.

(10) Patent No.: US 11,131,524 B1
(45) Date of Patent: Sep. 28, 2021

(54) CROSSBOW WITH INTEGRAL COCKING AND A MOVING LATCH

(71) Applicant: Archery Innovators, LLC, Tiffin, IA (US)

(72) Inventors: James J. Kempf, Coralville, IA (US); Rex E. Isenhower, Mount Pleasant, IA (US)

(73) Assignee: ARCHERY INNOVATORS, LLC, Tiffin, IA (US)

( * ) Notice: Subject to any disclaimer, the term of this patent is extended or adjusted under 35 U.S.C. 154(b) by 0 days.

(21) Appl. No.: 16/875,267

(22) Filed: May 15, 2020

(51) Int. Cl.
*F41B 5/12* (2006.01)
*F41B 5/14* (2006.01)
*F41B 5/10* (2006.01)

(52) U.S. Cl.
CPC ..... *F41B 5/1469* (2013.01); *F41B 5/12* (2013.01); *F41B 5/123* (2013.01); *F41B 5/105* (2013.01)

(58) Field of Classification Search
CPC ..... F41B 5/12
See application file for complete search history.

(56) References Cited

U.S. PATENT DOCUMENTS

| | | | | |
|---|---|---|---|---|
| 4,884,614 | A * | 12/1989 | Spurling | E06B 9/04 160/225 |
| 5,596,976 | A * | 1/1997 | Waiser | F41B 5/12 124/25 |
| 6,736,123 | B1 * | 5/2004 | Summers | F41A 17/46 124/25 |
| 7,174,884 | B2 | 2/2007 | Kempf | |
| 7,770,567 | B1 * | 8/2010 | Yehle | F41B 5/12 124/25 |
| 8,104,461 | B2 | 1/2012 | Kempf | |
| 8,770,178 | B2 * | 7/2014 | Kempf | F41A 19/10 124/25 |
| 9,255,754 | B1 * | 2/2016 | Kempf | F41B 5/12 |
| 9,360,268 | B2 * | 6/2016 | Khoshnood | F41B 5/10 |
| 9,638,487 | B1 * | 5/2017 | Liu | F41B 5/12 |
| 9,958,232 | B1 * | 5/2018 | Egerdee | F41B 5/1403 |
| 10,254,073 | B2 | 4/2019 | Yehle | |
| 10,401,117 | B1 * | 9/2019 | Rowzie, Jr. | F41B 5/12 |

* cited by examiner

*Primary Examiner* — John A Ricci
(74) *Attorney, Agent, or Firm* — Donald J. Ersler

(57) ABSTRACT

A crossbow having a moving trigger assembly, wherein the moving trigger assembly includes a housing and components capable of select-ably retaining and releasing a bowstring, wherein the trigger arm is movable with the assembly.

14 Claims, 23 Drawing Sheets

CROSSBOW WITH INTEGRAL COCKING AND A MOVING LATCH

BACKGROUND OF THE INVENTION

1. Field of the Invention

The present invention relates generally to archery and more specifically to a crossbow with integral cocking and a moving latch assembly, which may or may not include a removal electric motor.

2. Discussion of the Prior Art

Prior art of U.S. Pat. No. 7,174,884 Kempf disclosed a crossbow cocking means of drawing a launch string from the center, by means known in the art. U.S. Pat. No. 8,104,461 Kempf disclosed a crossbow cocking means drawing a launch string from the center, having a flexible member wrapping a spool driven by a gear. U.S. Pat. No. 6,095,128 Bednar discloses a crossbow crank cocking device mounted on the stock having a sled engaged with the string, cranking the string into the cocked position, disengaging the sled from said launch string, and "parking" the sled with the stock. U.S. Pat. No. 10,254,073 Yehle discloses a moving latch assembly wherein a housing travels for and aft the crossbow frame, forward engaging a launch string, and rearward to cock the crossbow, the assembly contains a latch, a sear, a safety, and an anti dry-fire, wherein the trigger is fastened or attached to the center rail. Though the easiest to use, Yehle creates many issues wherein stacking tolerances may adversely effects the precision and reliability of the assembly, in that the trigger and trigger lever are de-coupled from the sear lever during every cocking cycle.

Advantageously, the present invention allows for a more reliable, more precise, easier to manufacture and easier to use cocking system and trigger assembly for a crossbow.

SUMMARY OF THE INVENTION

The enclosed invention discloses a crossbow, and more specifically a built in cocking mechanism for a crossbow that may also be utilized with an optional built in, removable motor gearbox assembly and power source. The motor gearbox assembly may or may not have a clutch assembly, whereby the rotational force applied by the said motor gearbox assembly reaches a predetermined amount of force, the rotation of the main drive shaft ceases. A switch may be provided as to start, stop, and reverse the direction of rotation of the motor gearbox assembly, as well as switches and or circuits that may control operation of the motor gear set. A moving trigger assembly for a crossbow having the trigger arm coupled to the moving assembly allows for a more consistent interface between the trigger arm and the sear lever, eliminating tolerance issues generally associated with crossbows having a moving trigger assembly and a static-position trigger arm.

DETAILED DESCRIPTION OF THE INVENTION

Figure 1:
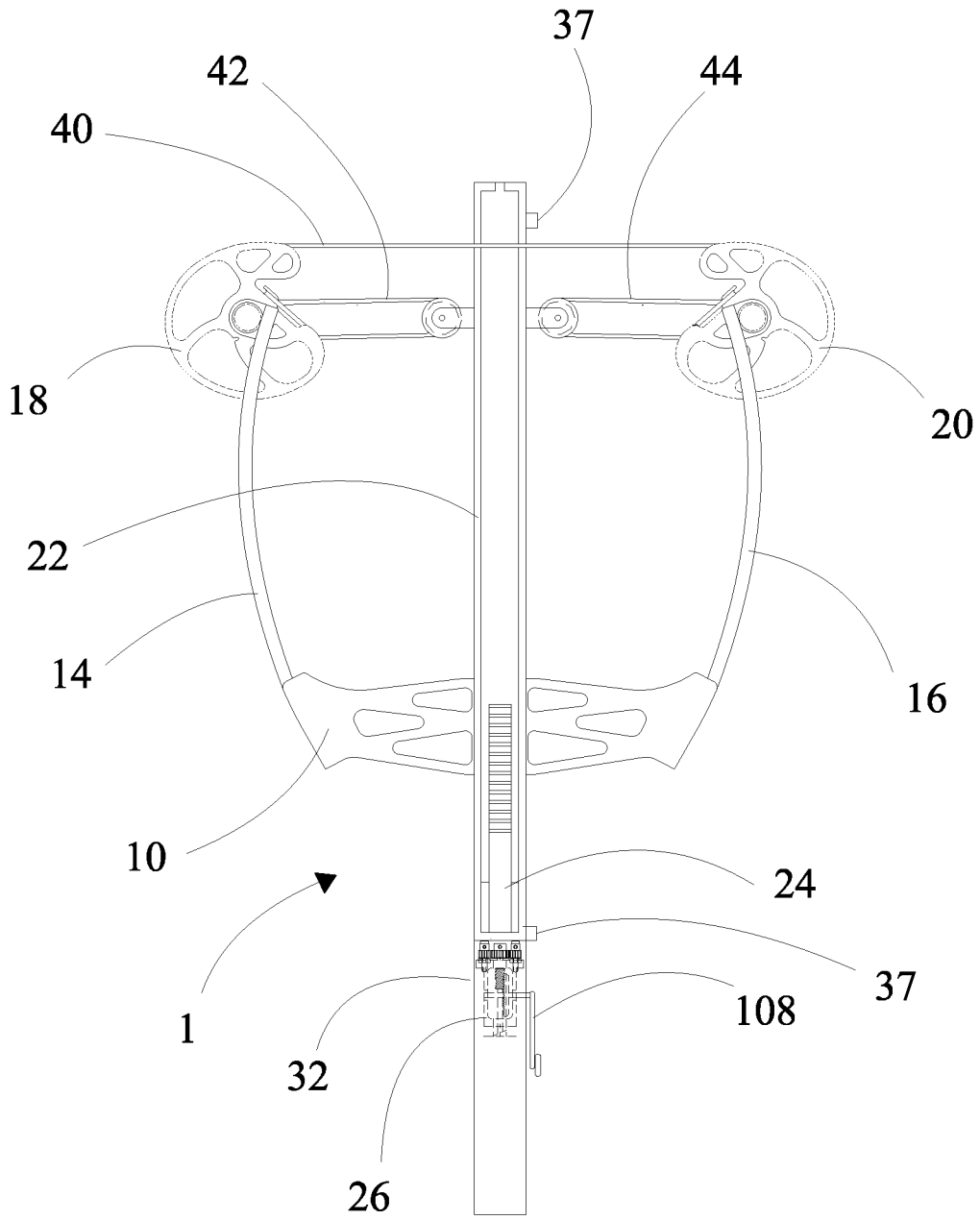
FIG. 1 is a top view of a crossbow with built in crank cocking device having a movable latch housing assembly, in the at rest position, of the present invention.
Figure 1A:
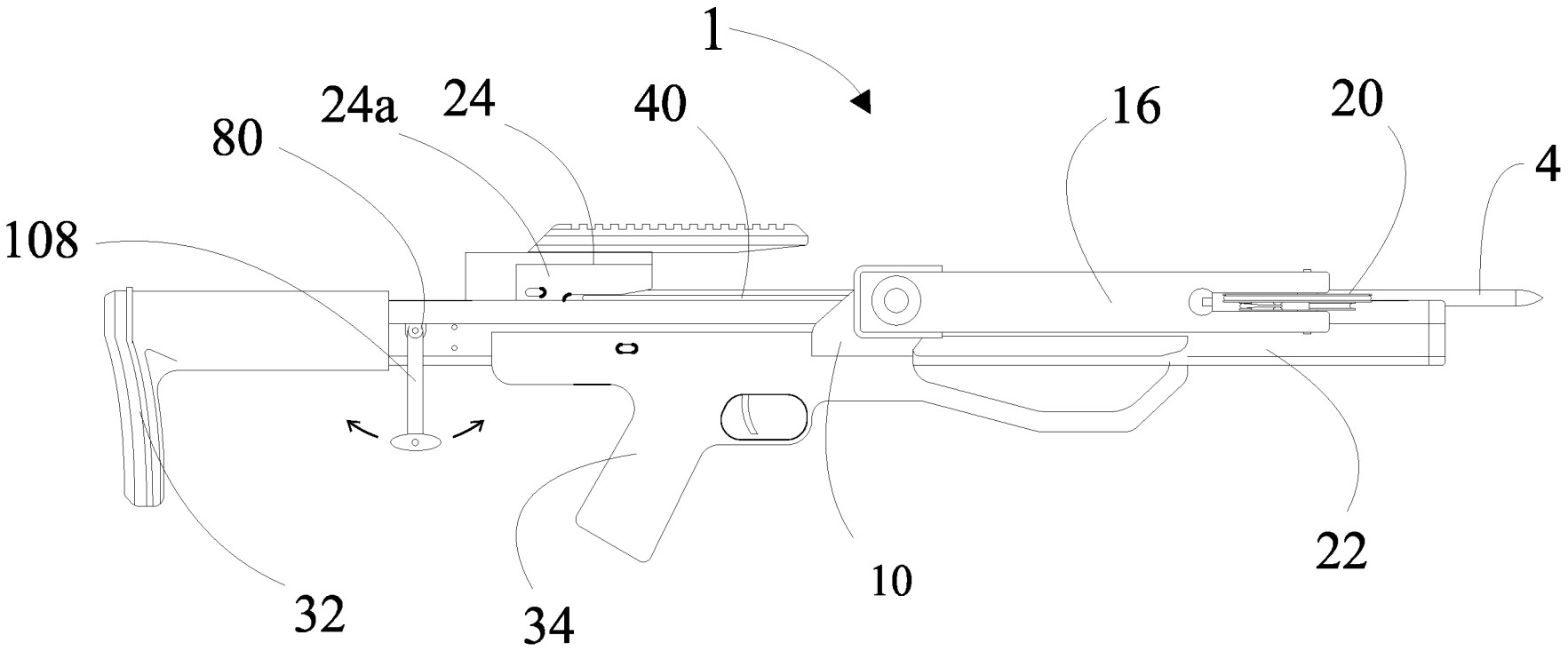
FIG. 1A is a side view of a crossbow with built in crank cocking device having a movable latch housing assembly, in the cocked position, of the present invention.
Figure 1B:
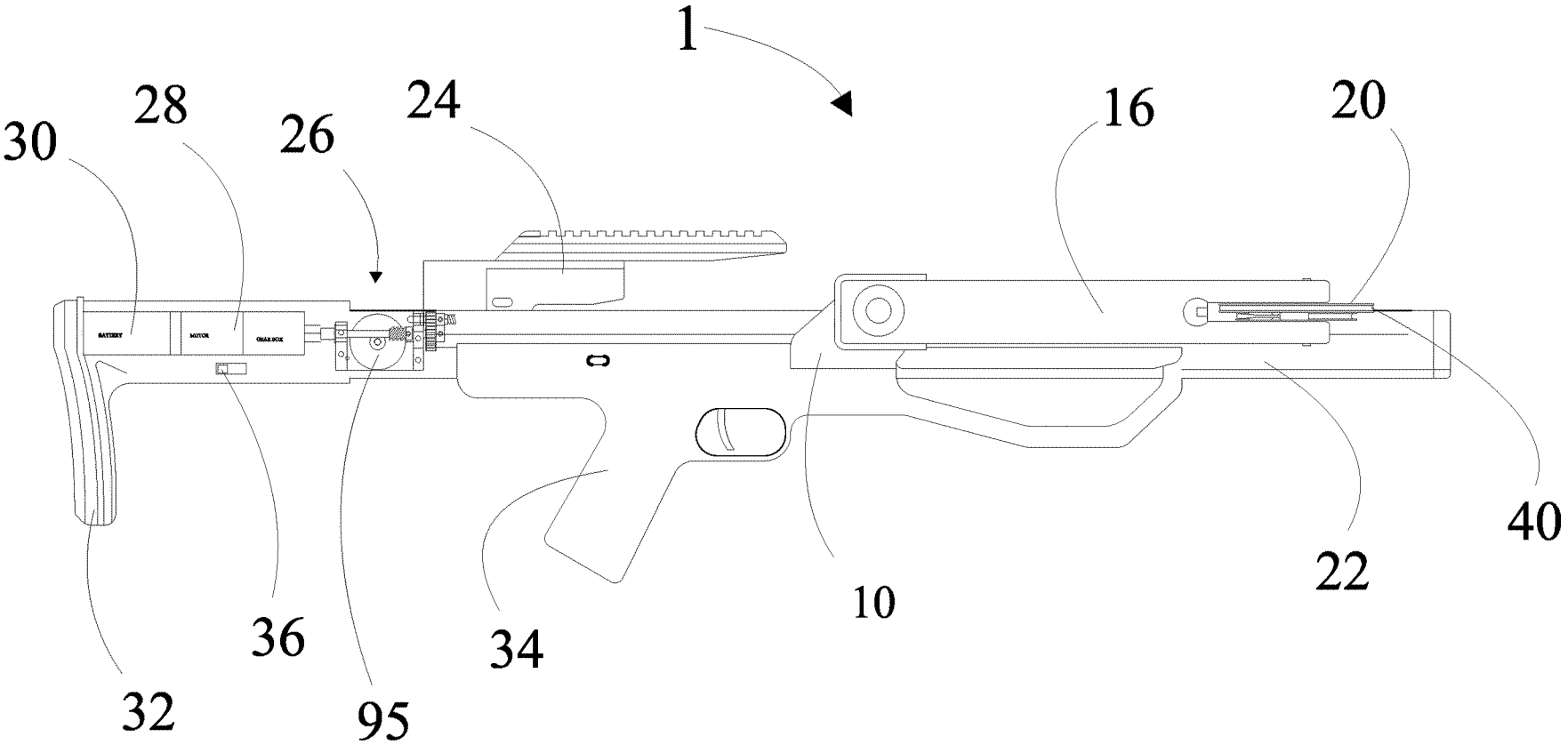
FIG. 1B is a side view of a crossbow with built in crank cocking device having a movable latch housing assembly, with the optional motor gearbox assembly and power source, in the at rest position, of the present invention.
Figure 1C:
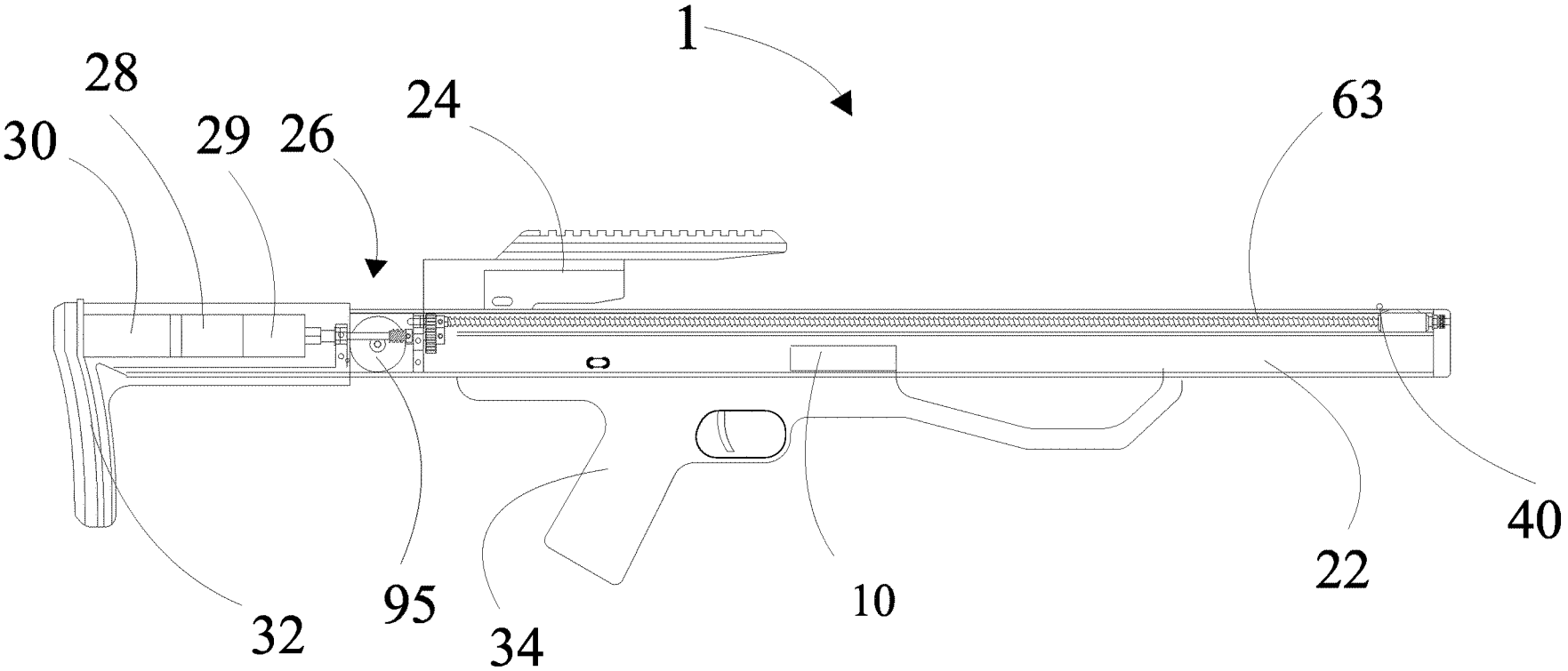
FIG. 1C is a partial cut-away side view of a crossbow with built in crank cocking device having a movable latch housing assembly, with the optional motor gearbox assembly and power source, in the at rest position. The carriage shaft assembly and crank assembly are illustrated with the crossbow of the present invention.
Figure 1D:
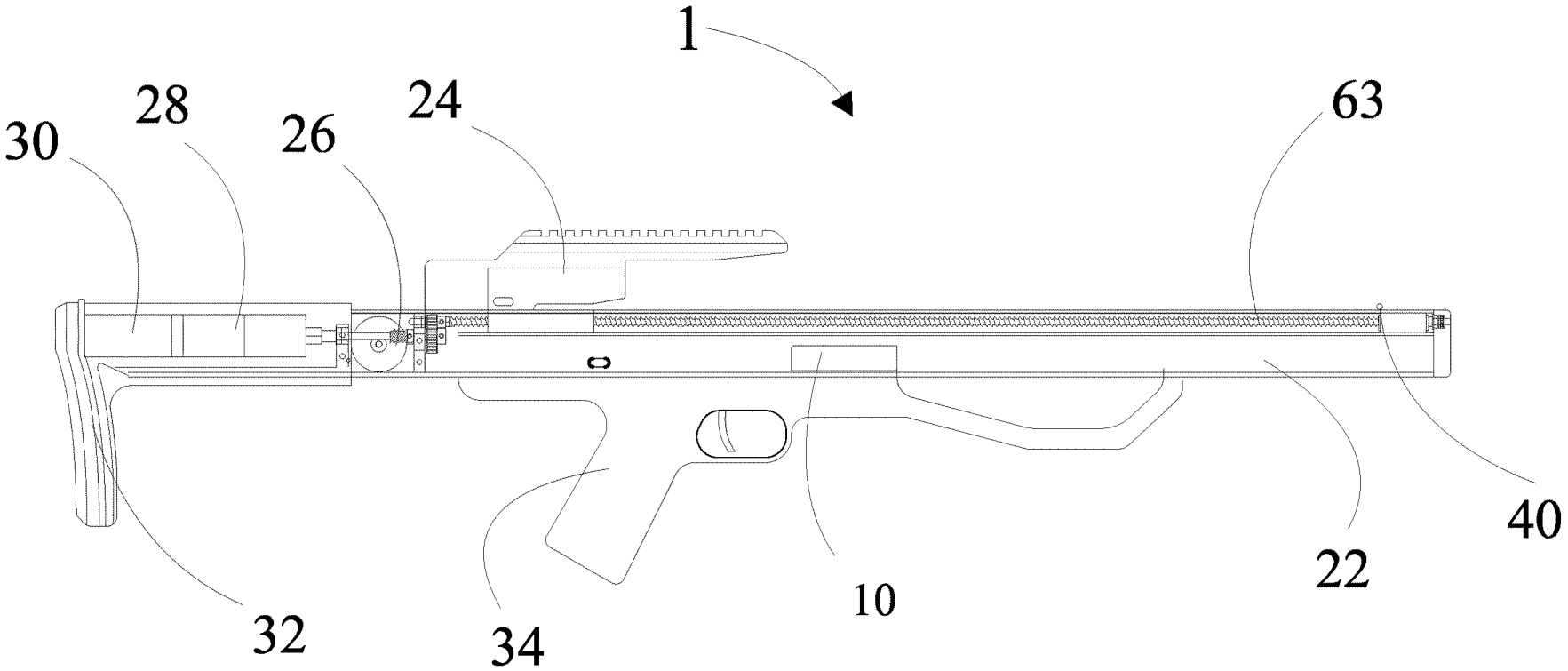
FIG. 1D is a partial cut-away side view of a crossbow with built in crank cocking device having a movable latch housing assembly, with the optional motor gearbox assembly and power source, in the at rest position. The carriage shaft assembly and crank assembly are illustrated with the crossbow of the present invention.
Figure 1E:
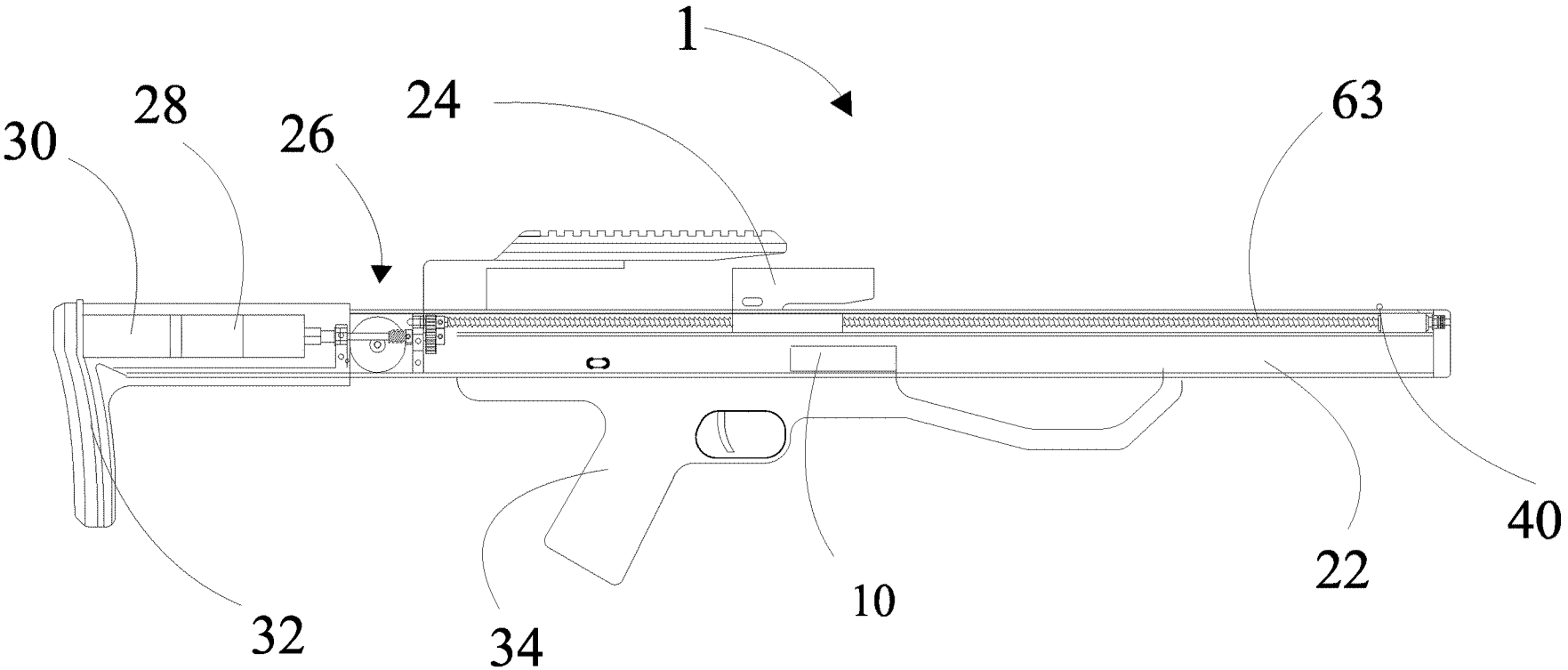
FIG. 1E is a partial cut-away side view of a crossbow with built in crank cocking device having a movable latch housing assembly, with the optional motor gearbox assembly and power source, in the partially cocked position. The carriage shaft assembly and crank assembly are illustrated with the crossbow of the present invention.
Figure 1F:
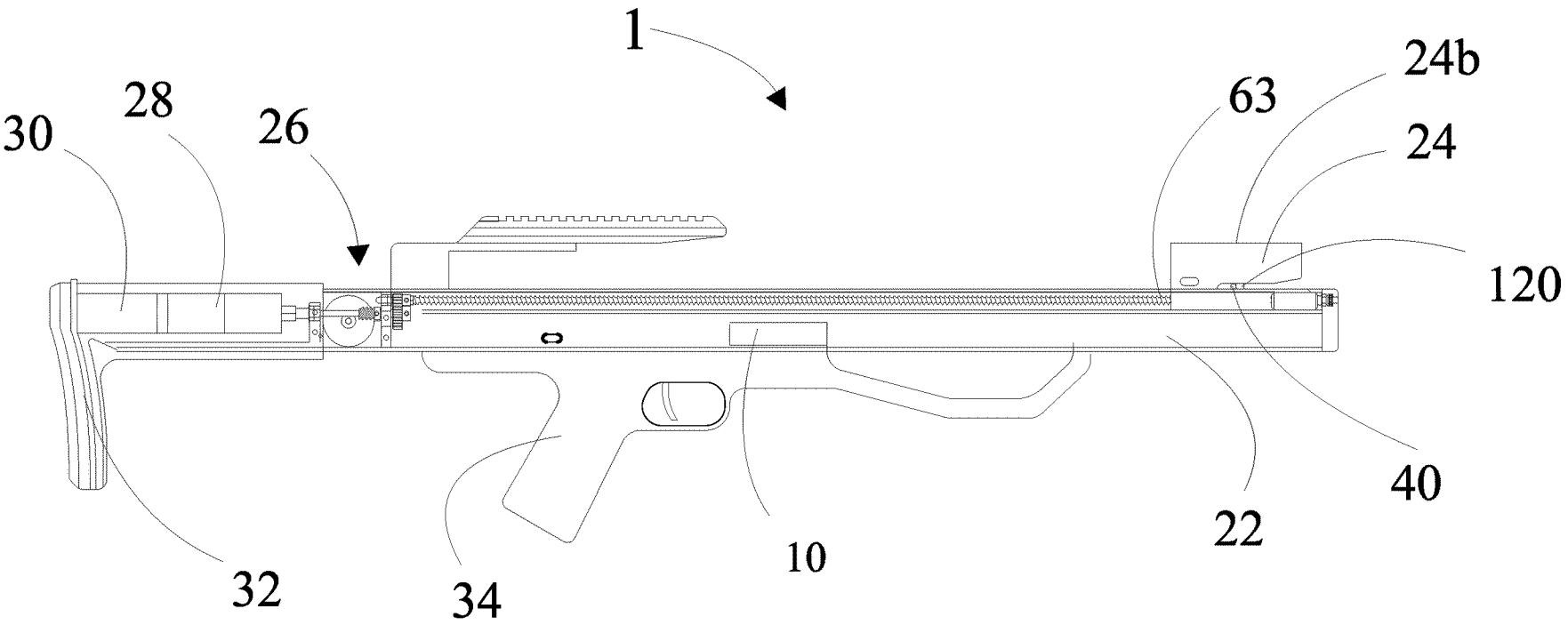
FIG. 1F is a partial cut-away side view of a crossbow with built in crank cocking device having a movable latch housing assembly, with the optional motor gearbox assembly and power source, having the latch housing assembly at the very forward position to engage the bow string. The carriage shaft assembly and crank assembly are illustrated with the crossbow of the present invention.
Figure 2:
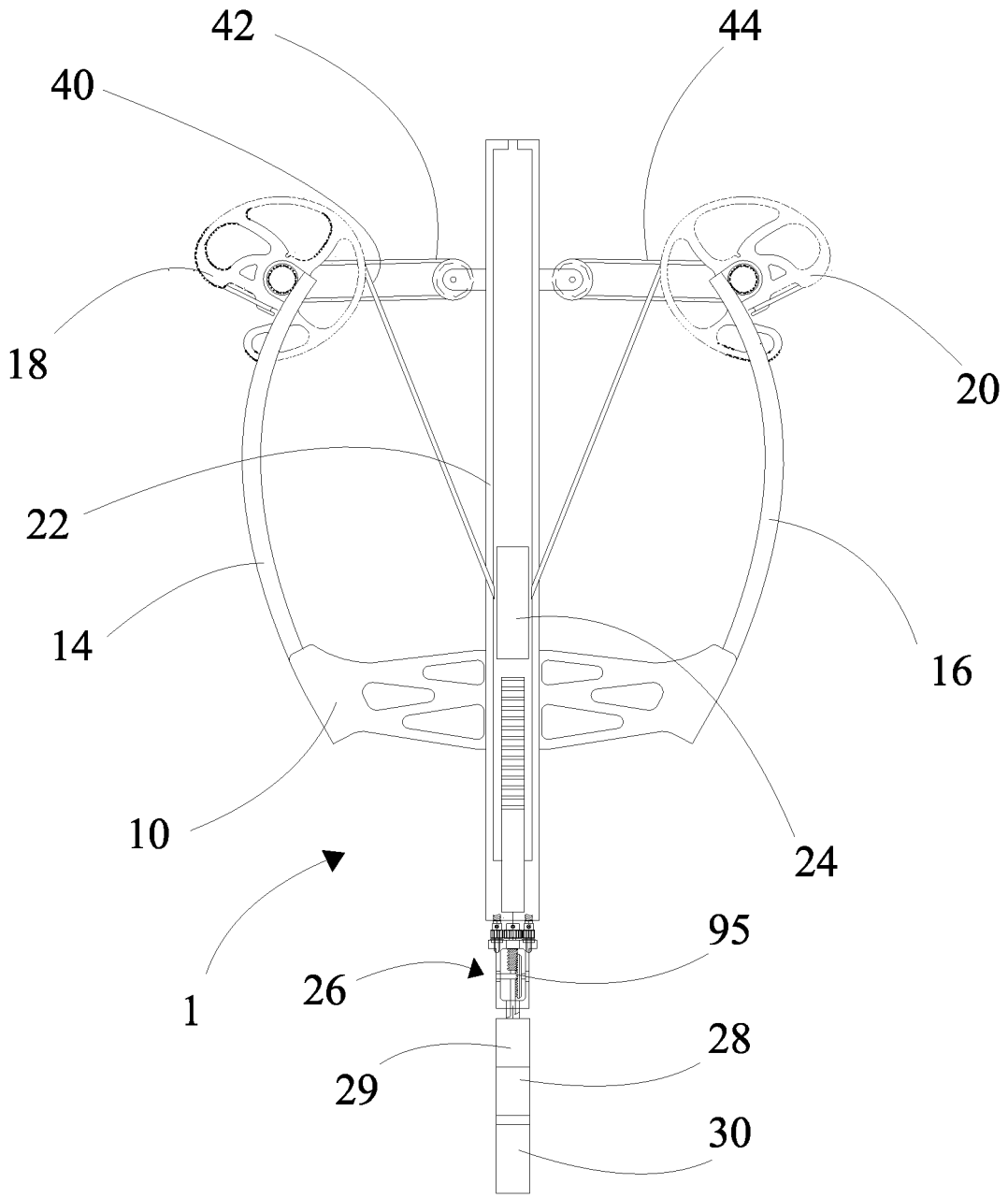
FIG. 2 is a top view of a crossbow with built in crank cocking device and optional motor gearbox assembly having a movable latch housing assembly, in the partially cocked position, of the present invention.
Figure 3:
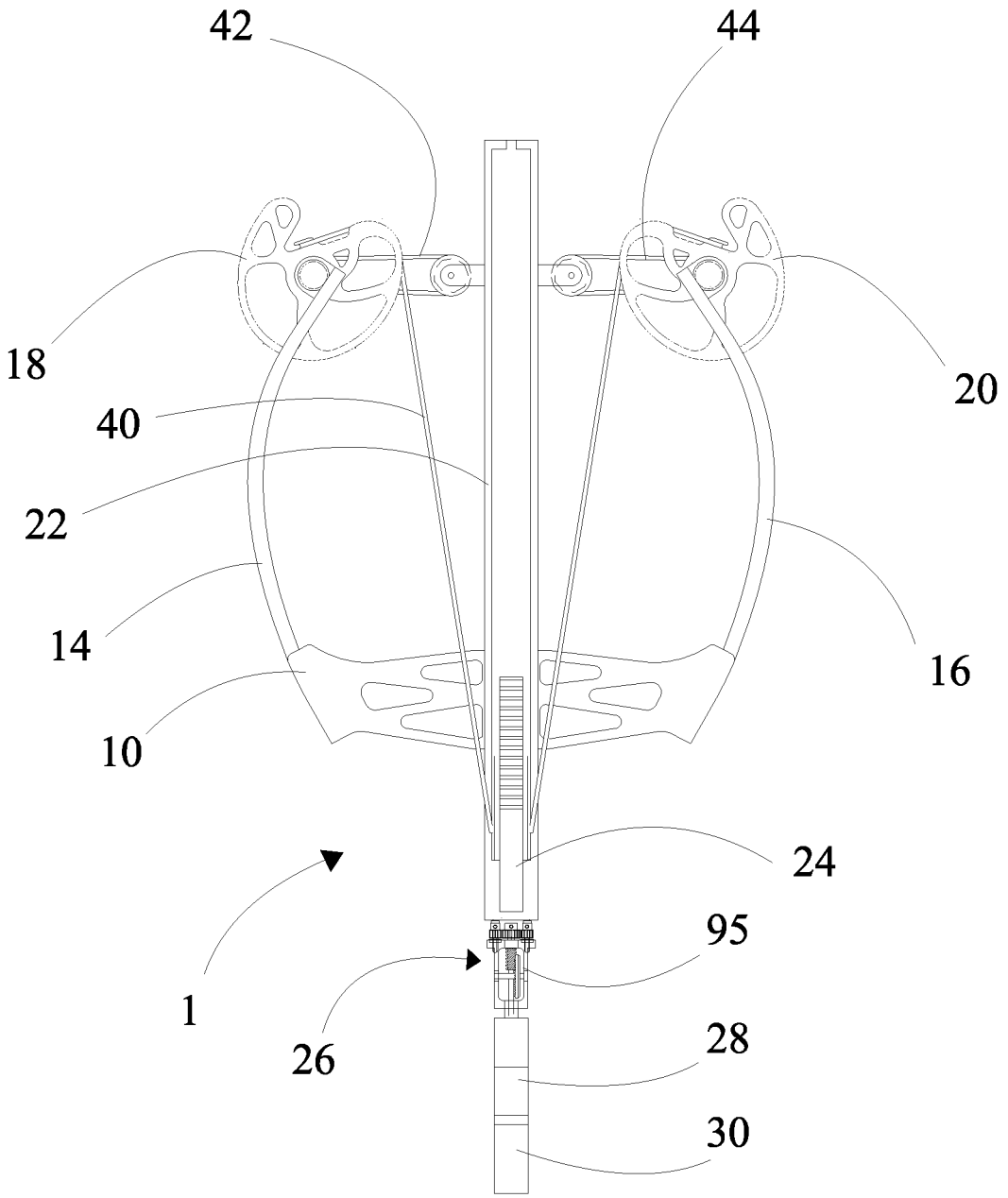
FIG. 3 is a top view of a crossbow with built in crank cocking device with built in motor gearbox assembly having a movable latch housing assembly, in the just-cocked position, of the present invention.
Figure 3A:
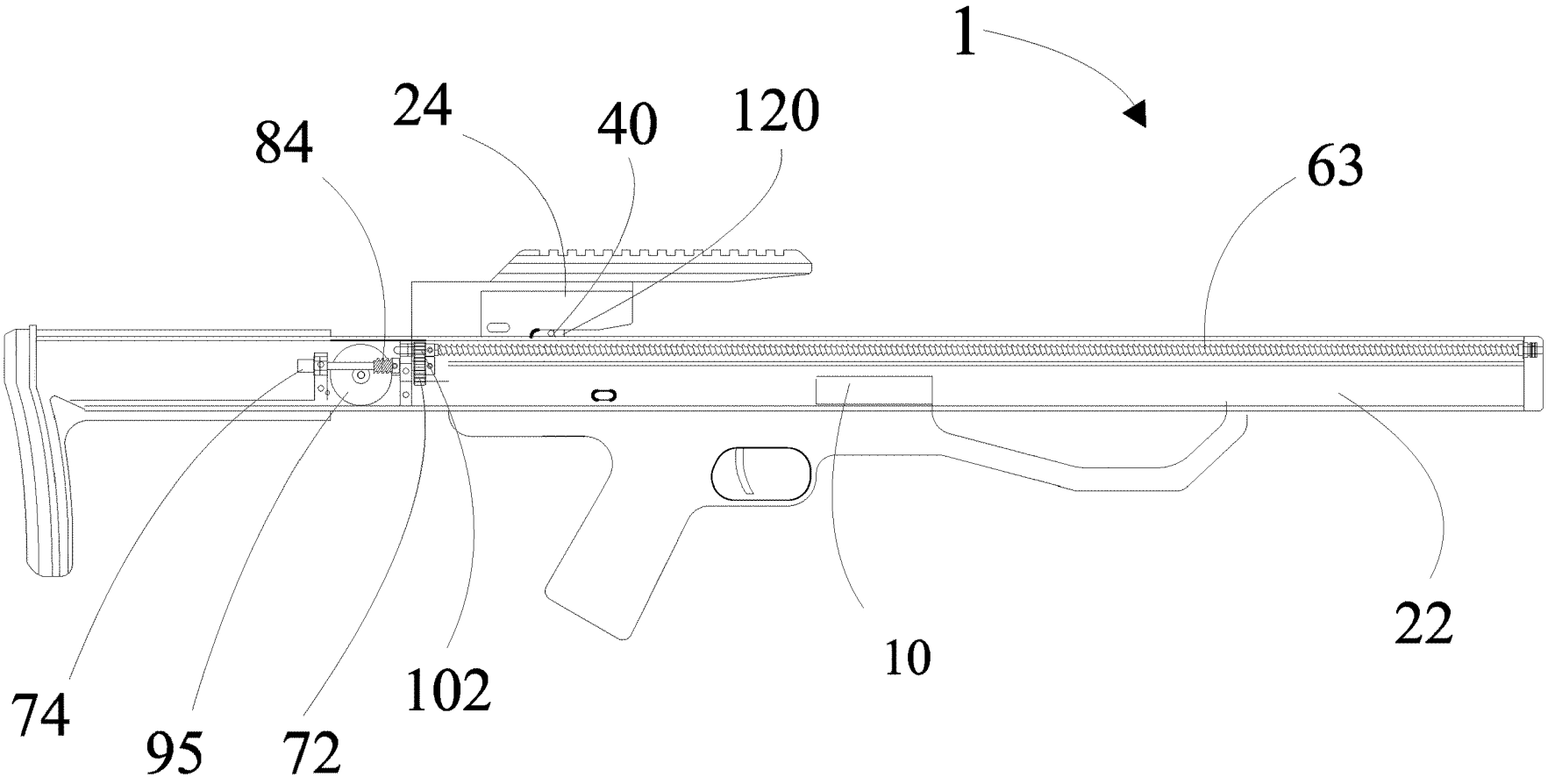
FIG. 3A is a partial cut-away side view of a crossbow with built in crank cocking device with motor gearbox assembly having a movable latch housing assembly, in the just-cocked position, of the present invention
Figure 4:
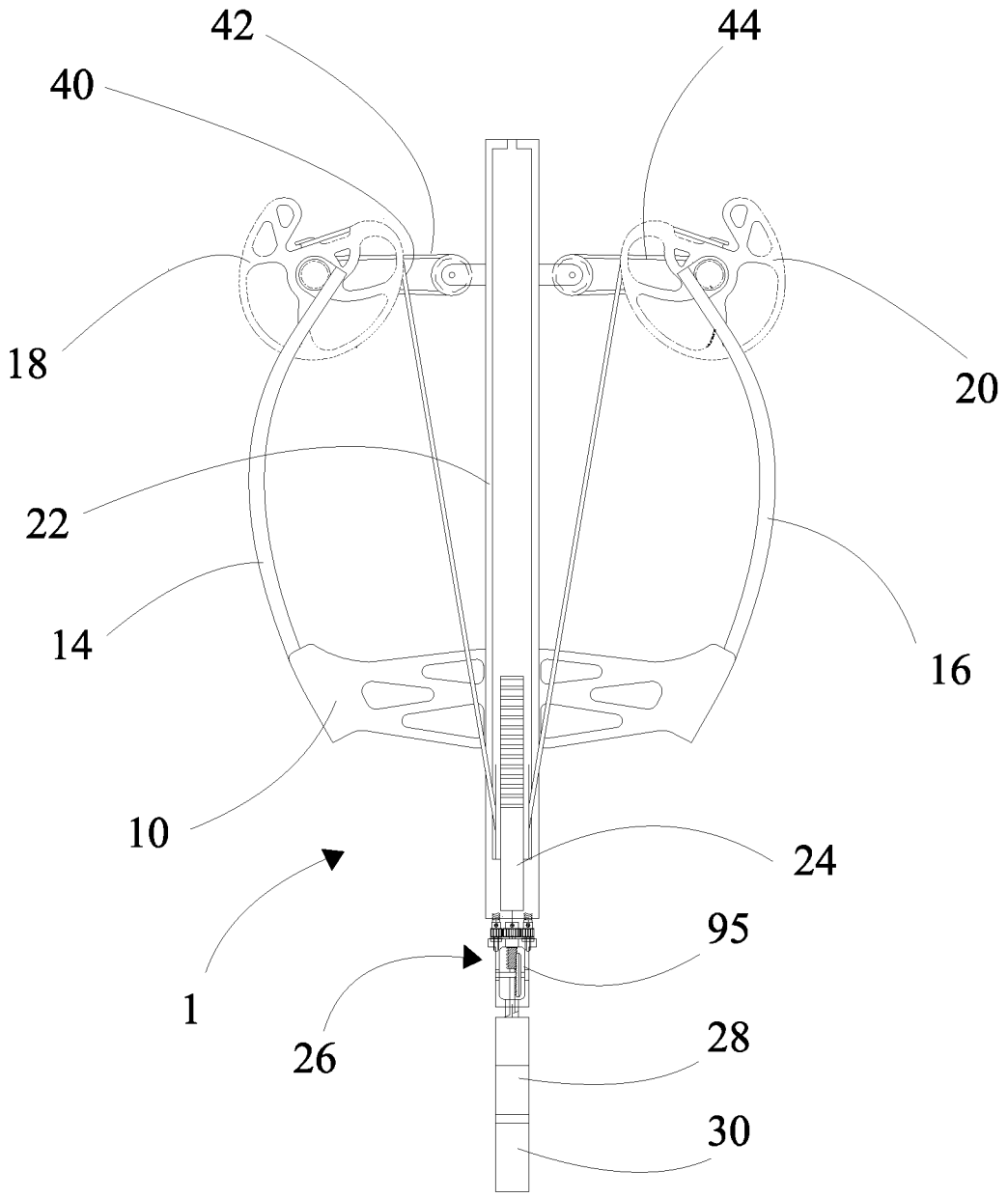
FIG. 4 is a top view of a crossbow with built in crank cocking device with motor gearbox assembly having a movable latch housing assembly, in the cocked position, of the present invention.
Figure 4A:
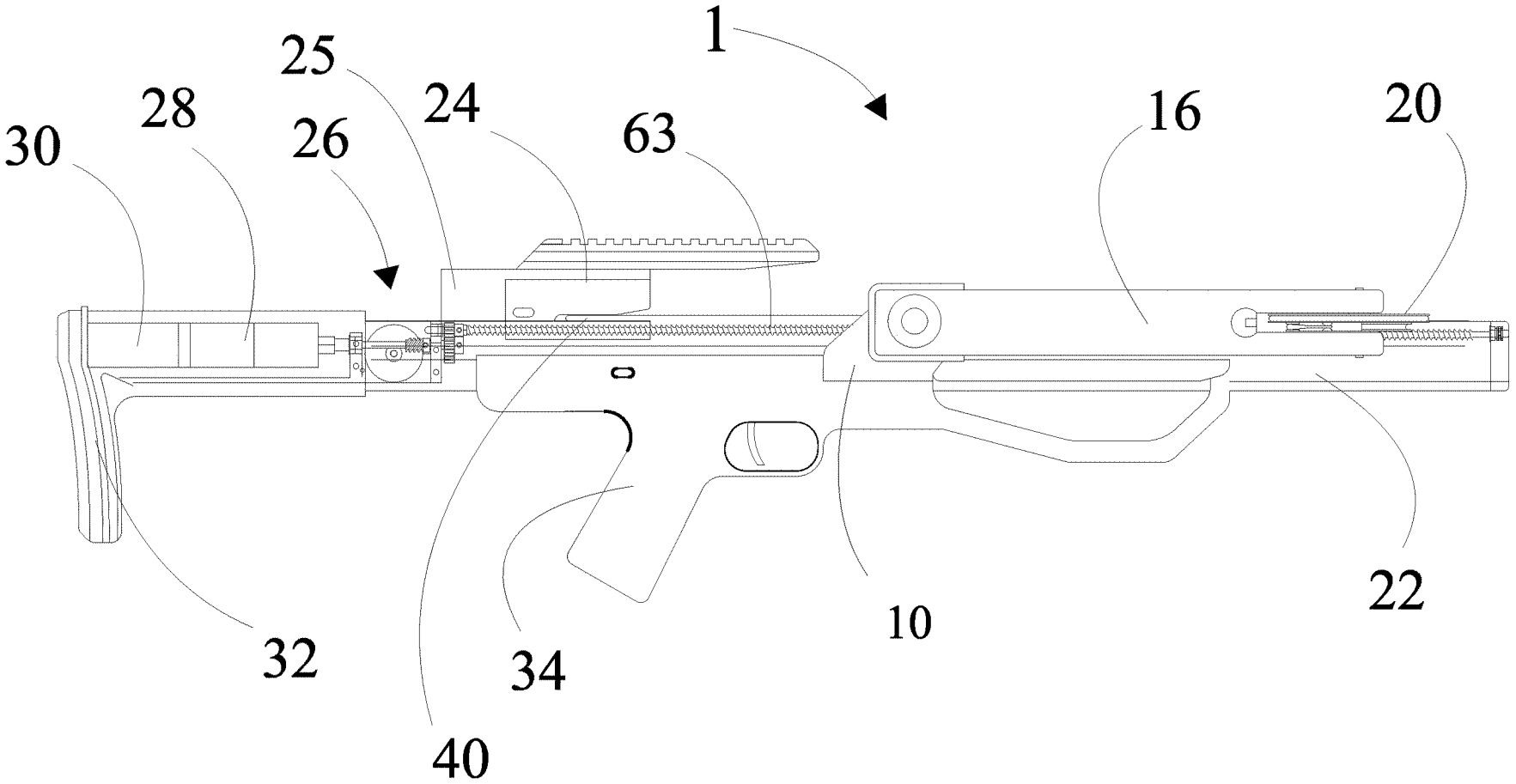
FIG. 4A is a partial cut-away side view of a crossbow with built in crank cocking device with motor gearbox assembly having a movable latch housing assembly, in the cocked position, of the present invention.
Figure 5A:
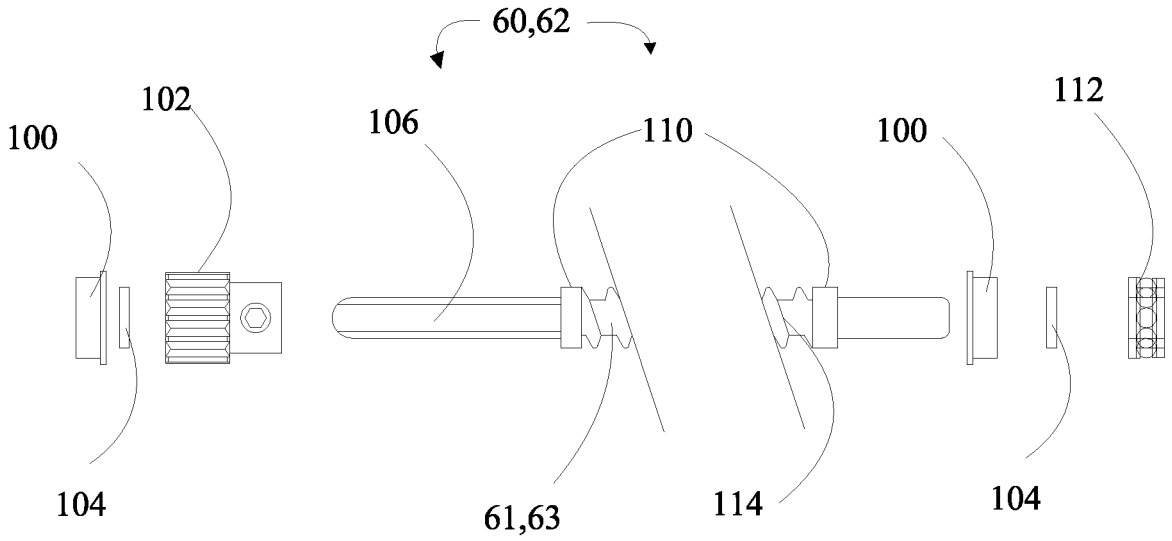
FIG. 5A is an exploded view of a carriage shaft assembly, of the present invention.
Figure 5B:
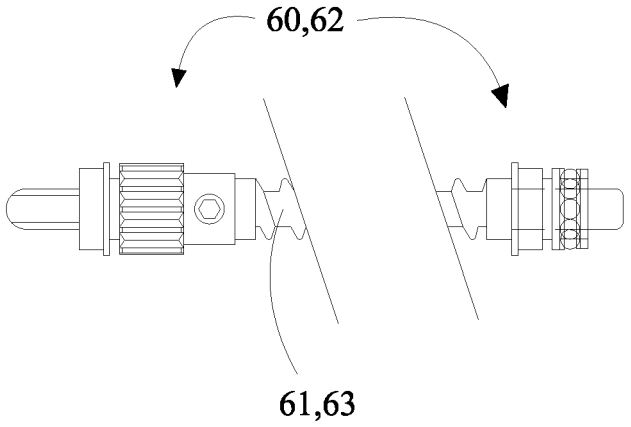
FIG. 5B is an assembled view of a carriage shaft assembly, of the present invention.
Figure 6A:
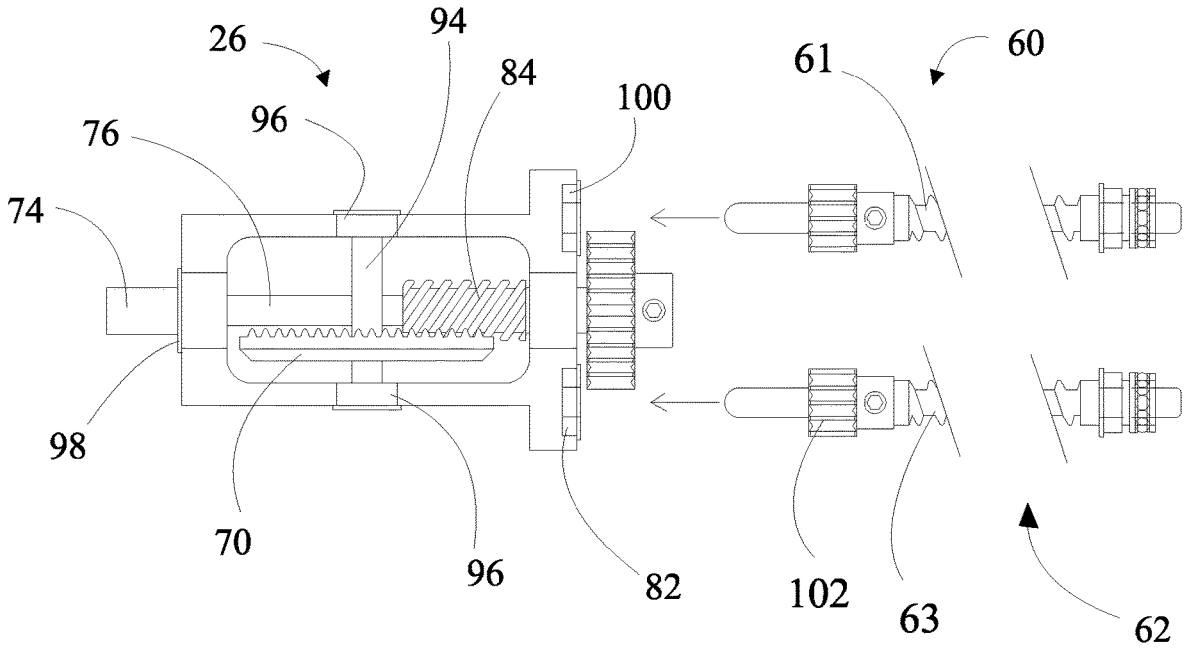
FIG. 6A is a top view of the crank assembly of the present invention.
Figure 6B:
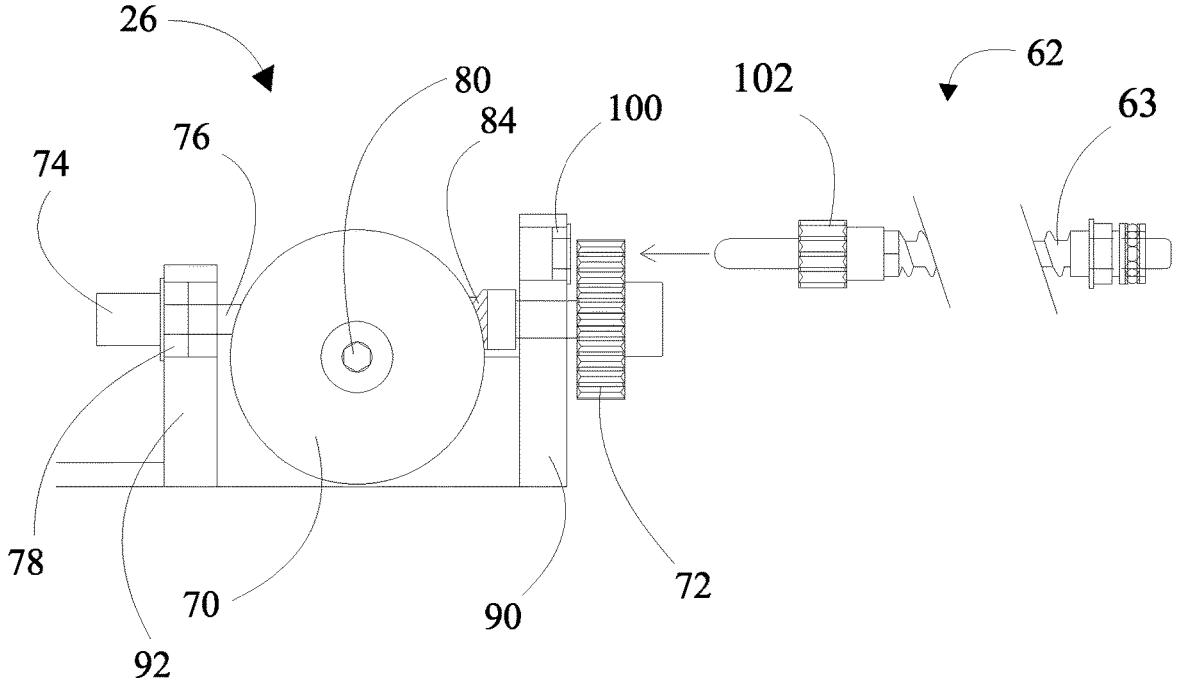
FIG. 6B is a side view of the crank assembly of the present invention.
Figure 7A:
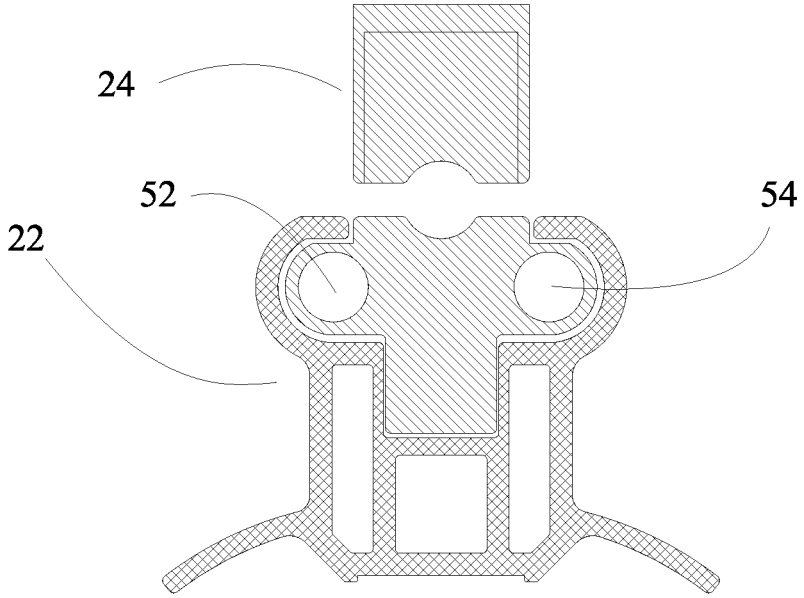
FIG. 7A is a cross section of latch housing assembly and barrel having two latch housing drive shafts of the present invention.
Figure 7B:
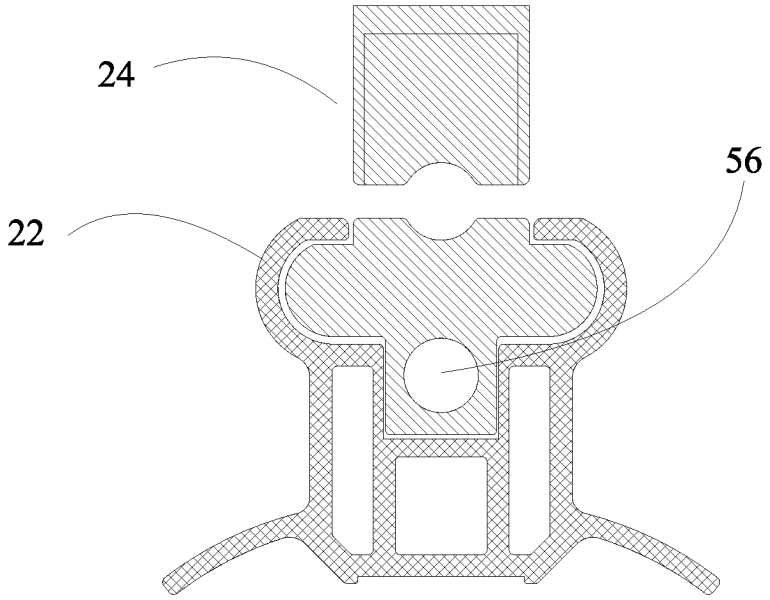
FIG. 7B is a cross section of latch housing assembly and barrel having a single latch housing drive shaft of the present invention.
Figure 8A:
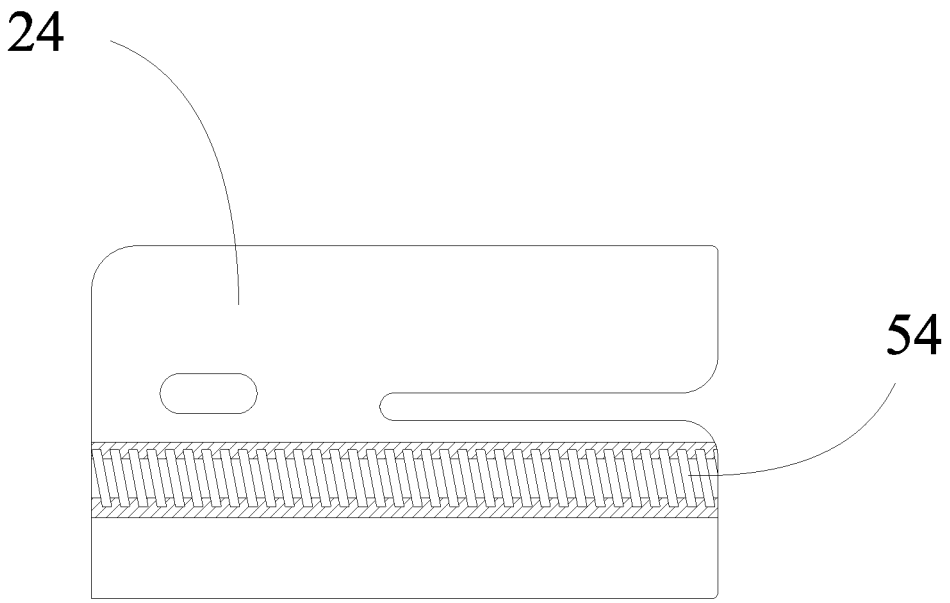
FIG. 8A is a partial cross section side view of a latch housing having two latch housing drive shafts of the present invention.
Figure 8B:
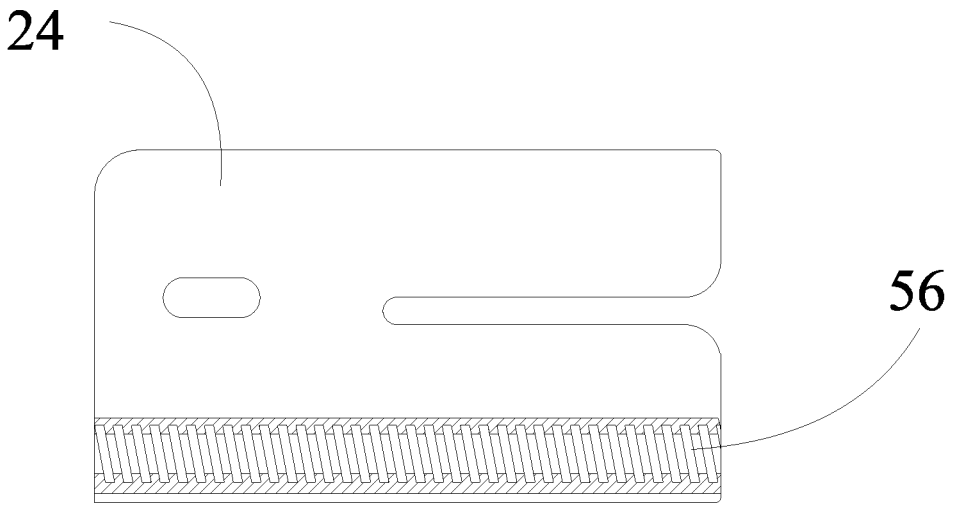
FIG. 8B is a partial cross section side view of a latch housing having a single latch housing drive shafts of the present invention.
Figure 9:
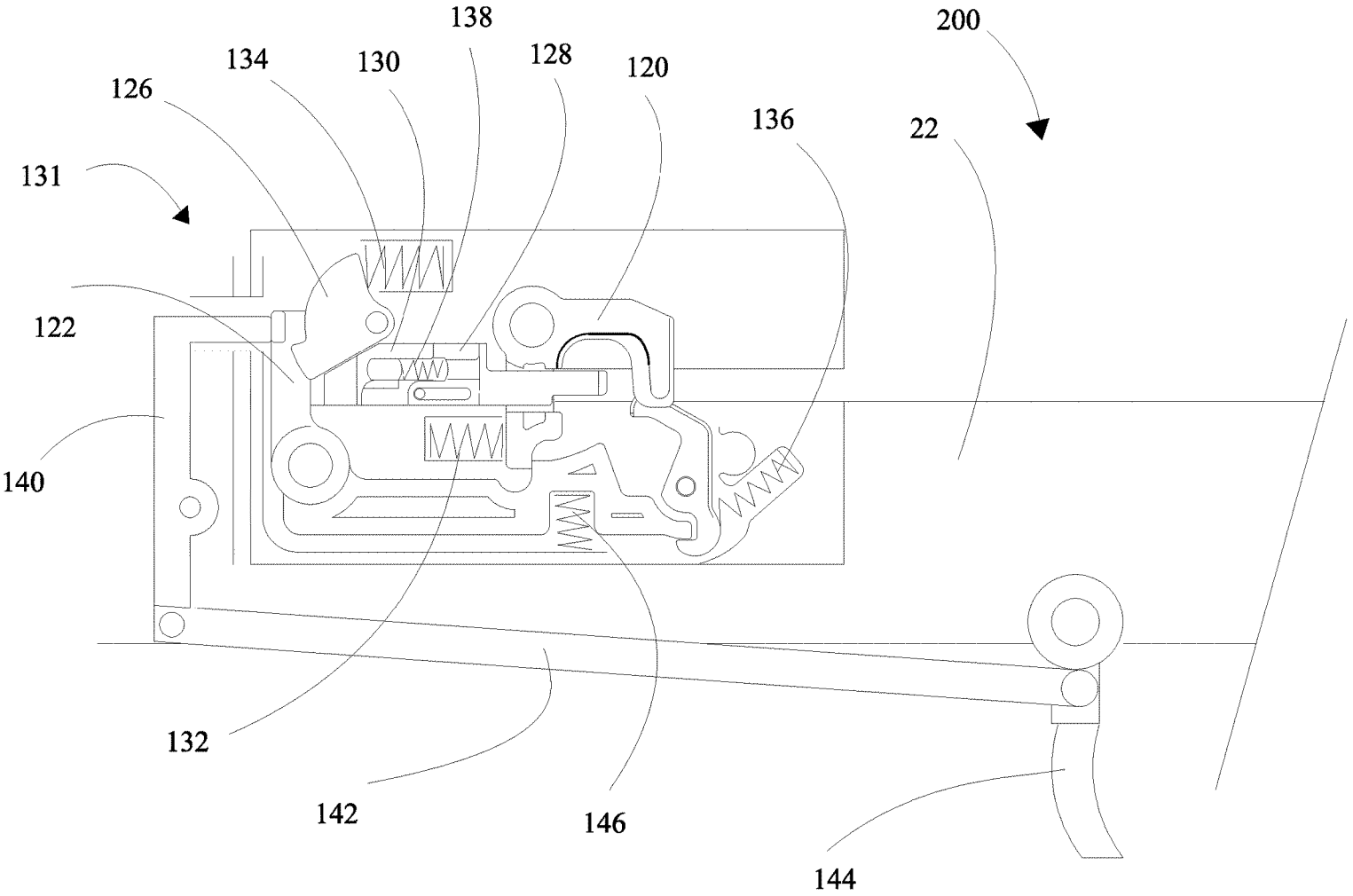
FIG. 9 is an open side view of a latch assembly of the present invention.

The enclosed invention discloses a crossbow 1, and more specifically a built in cocking mechanism for a crossbow that may also be utilized with an optional built in, removable motor gearbox assembly 28 and power source 30. The motor gearbox assembly 28 may or may not have a clutch assembly 29, whereby the rotational force applied by the said motor gearbox 28 assembly reaches a predetermined amount of force, the rotation of the main drive shaft 76 ceases. A switch 36 may be provided as to start, stop, and reverse the direction of rotation of the motor gearbox assembly 28.

In use, a clutch assembly 29 in the motor gear assembly 28 would prevent the string latch housing assembly 24 from traveling past the predetermined forward or rearward position of the string latch housing assembly 24 during the cocking and unlocking procedure. A micro-switch with electronic eye 37 may also be used to control the operation of the motor gear box assembly 28.

Unique to the disclosed invention, is the use of a hand crank assembly 26. A hand crank 108 is coupled to a crank drive gear 95 mating to a drive shaft pinion gear 84. The drive shaft 76 is in-turn connected to a main drive shaft drive gear 72 on a first end, and a motor gearbox assembly coupling 74 at a second end. The main drive shaft drive gear 72 is coupled to the latch housing shaft drive gears 102. As the hand crank 108 is turned, rotational forces of the hand crank drive gear 95 turn the drive shaft pinion gear 84, in turn causing rotation of the drive shaft drive gear 72. As the drive shaft drive gear 72 rotates, it causes rotation of the first and second string latch housing drive shafts 61 and 63. At least one internally threaded engagement journal 54 is coupled with the string latch housing assembly 24 on the string latch housing drive shaft 61. The first and second string latch housing drive shaft assemblies 60 and 62 act as a worm drive or acme thread conveyor. As the first and second string latch housing drive shafts 61 and 63 rotate, the string latch housing 24 moves forward or backwards, depending on the direction of rotation of the first and second string latch housing drive shafts 61 and 63 rotate.

When in use, the hand crank 108 is turned a first direction, causing the string latch housing assembly 24 to move forward and engage the string 40. Once the string catch 120 is latched to the string 40, the hand crank 108 is rotated in a second direction until the string latch housing assembly 24 is in the ready-to-fire position.

Another unique feature of the disclosed invention is the optional built-in, removable motor gearbox assembly 28 that may take the place of the hand crank 108, without removal of the hand crank assembly 26.

Unique to the disclosed invention, is the use of a string latch housing assembly 24 movable by an integrated screw-drive type system. The use of an ACME thread is preferred, however any such system utilizing a rotational force through a screw-type shaft which moves a string latch housing assembly 24 from a first position 24*a* to a second position 24*b*, and again to a first position 24*a*. Said screw-type system has at least a first string latch housing shaft assembly 60. Said assembly 60 having a string latch housing drive shaft 61, threads 114, string latch housing drive shaft drive gear 102, journaled with bearings 100 at a first and second end, and received by at least a first internally threaded engagement journal 54 of the said string latch housing assembly 24. Said at least a first string latch housing drive shaft 61 is coupled to a rotational power source by the string latch housing drive shaft drive gear 102, which causes said string latch housing drive shaft 61 to rotate a first direction or a second direction. As said string latch housing drive shaft 61 rotates a first direction or a second direction, the threads 114 of said string latch housing drive shaft 61 cause he said string latch housing assembly 24 to move a first direction or a second direction. Disclosed in this invention is a device wherein said string latch housing assembly 24 is in a first position; a first directional rotational force is applied to string latch housing drive shaft 61; string latch housing drive shaft 61 moves string latch housing assembly 24 from a string latch housing assembly first position 24*a* to a string latch housing assembly second position 24*b*, wherein the string latch 120 engages the string 40; a second direction rotational force is applied to the string latch housing drive shaft 61; string latch housing drive shaft 61 moves said string latch housing assembly 24 and string 40 to said string latch housing assembly first position 24*a*.

The use of one or more integrated string latch housing drive shafts 61 and 63 may be used to accomplish movement of said string latch housing assembly 24. The use of an integrated string latch housing drive shaft type system of the disclosed invention is not limited to movement of a string latch housing assembly 24, but may be used to move as few as one component from a first position to a second position to assist in the process of moving said string 40 from a first position to a second position.

Further disclosed is a unique string latch assembly 200 and automatic safety device. Said string latch assembly 200 comprises a string latch 120, a seer lever 122, an anti-dry fire/sear-lock lever 124, springs, and an automatic safety assembly 131. Said automatic safety assembly 131 consists of three components and two springs. A first compression spring 138 is positioned between the front safety portion 128 and the rear safety portion 130, comprising a safety assembly. A second compression spring 134 is engaged with the safety pivot block 126. The automatic safety assembly 131 has a first extended position, a compressed position, and a second extended position.

Figure 10:
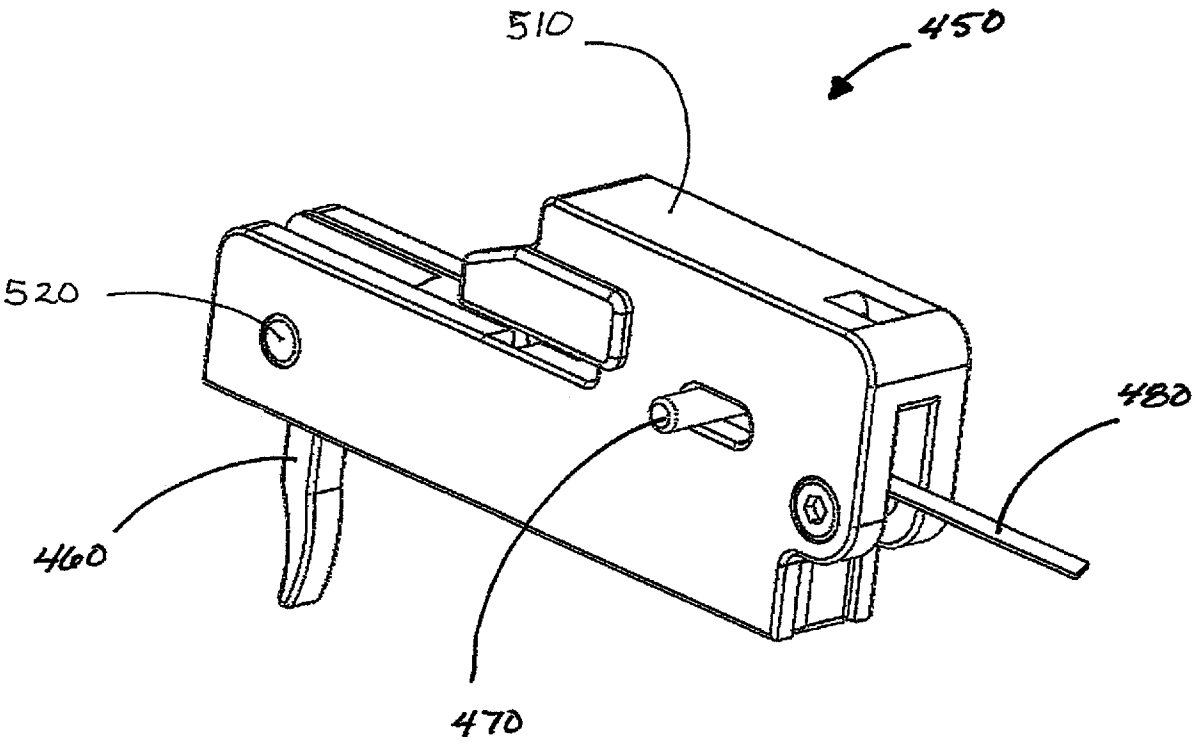
FIG. 10 is a view of a moving latch housing with a trigger arm coupled to the moving latch housing, wherein the moving latch housing is being moved by a strap of the present invention.
Figure 11:
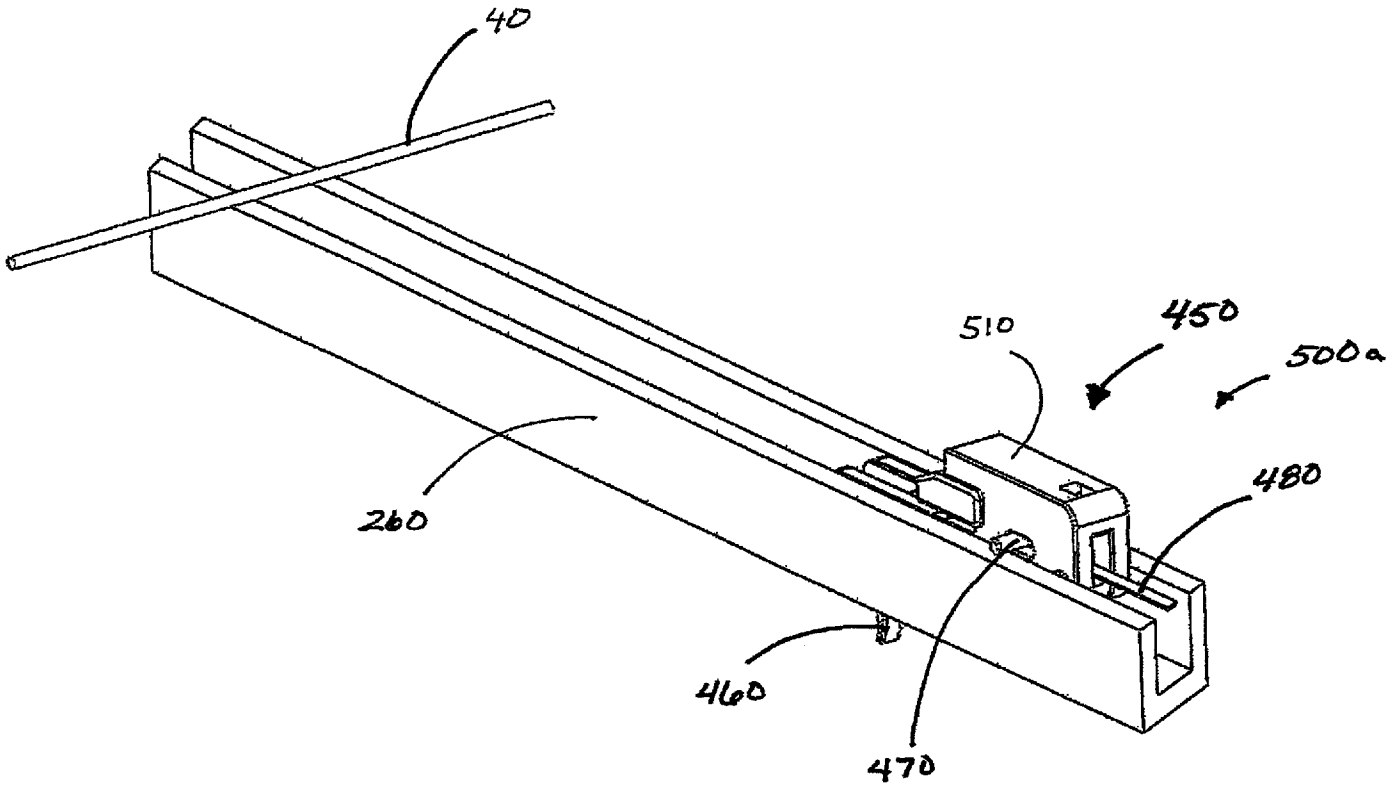
FIG. 11 is a view of a partial view of a moving latch housing with a trigger arm coupled to the moving latch housing, wherein the moving latch housing is being moved by a strap and retained by an elongated frame member of a crossbow of the present invention.
Figure 12:
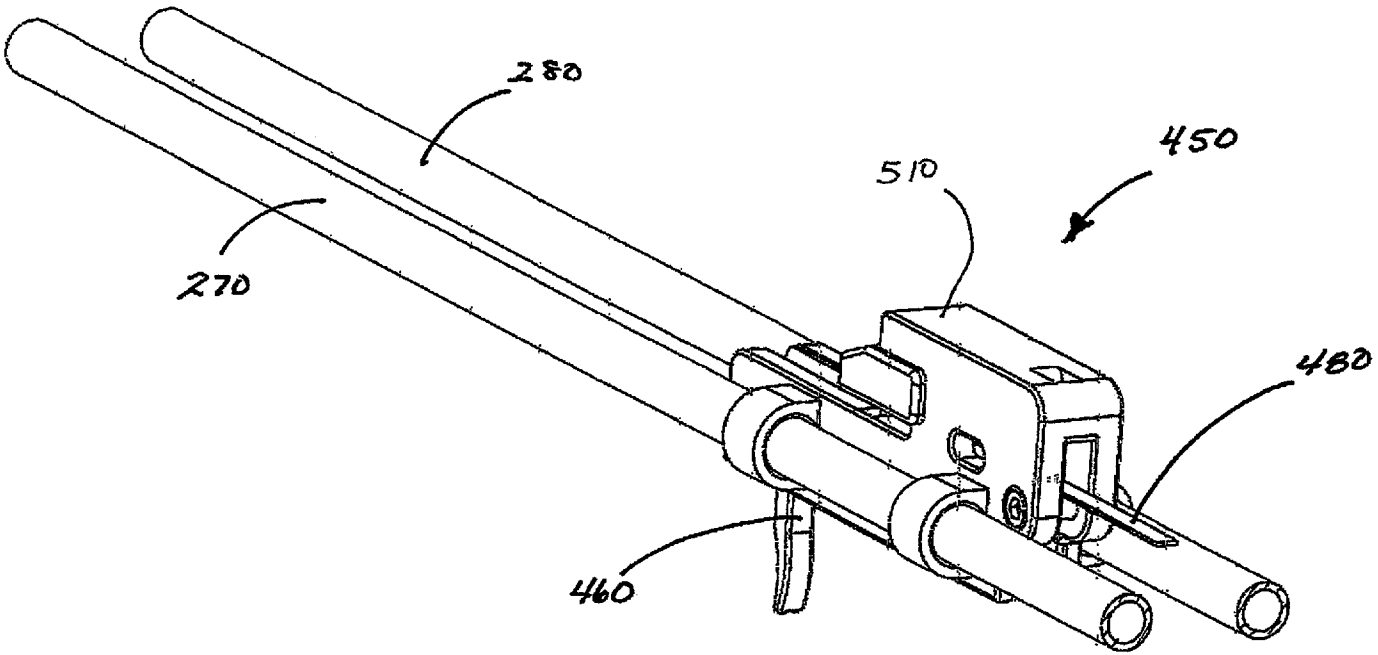
FIG. 12 is a view of a partial view of a moving latch housing with a trigger arm coupled to the moving latch housing, wherein the moving latch housing is being moved by a strap and retained by an elongated frame members (tubes or rods) of a crossbow of the present invention.
Figure 13:
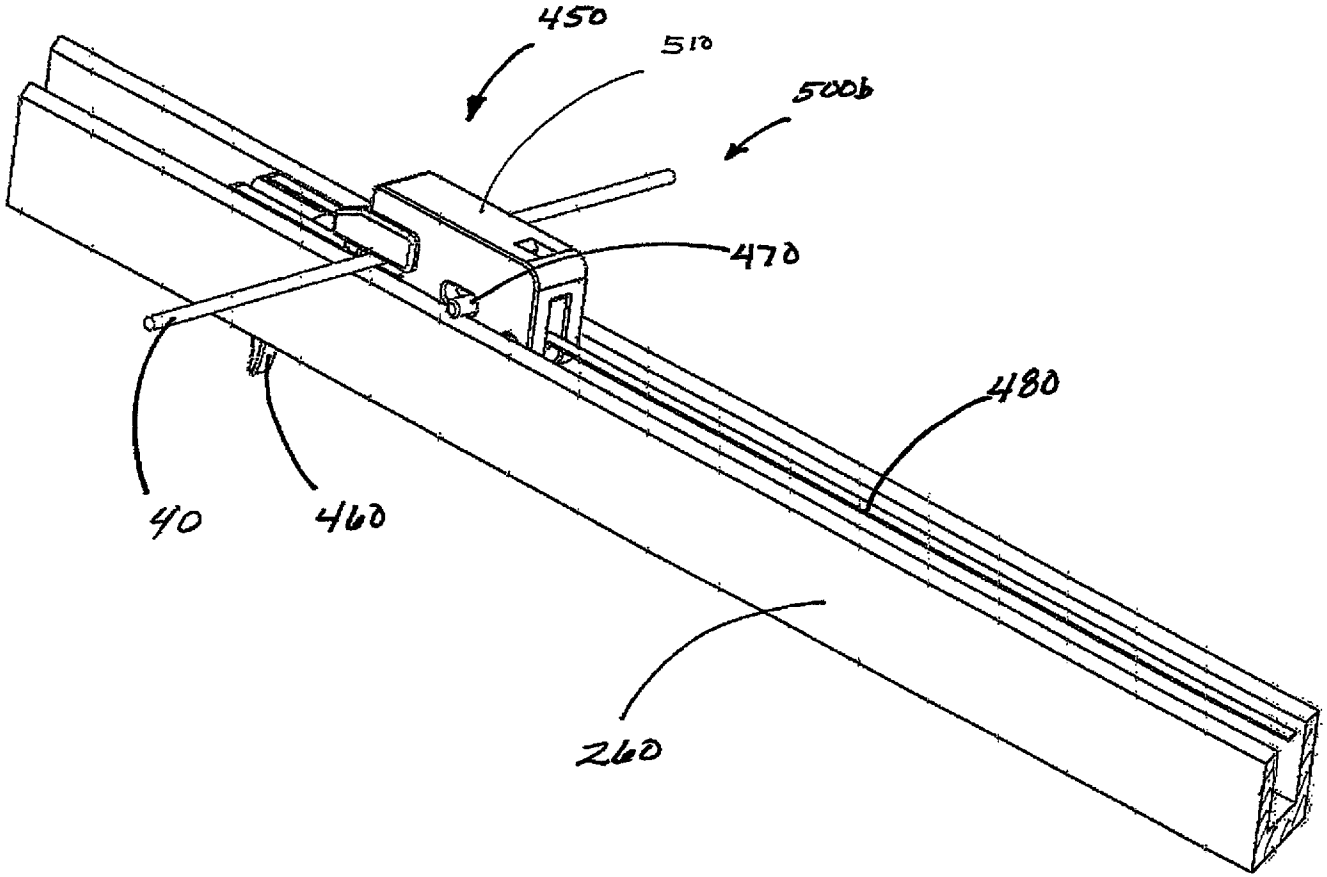
FIG. 13 is a view of a partial view of a moving latch housing with a trigger arm coupled to the moving latch housing, the moving latch housing is being moved by a strap and retained by an elongated frame members wherein the moving latch assembly is retaining a bowstring of a crossbow of the present invention.
Figure 14:
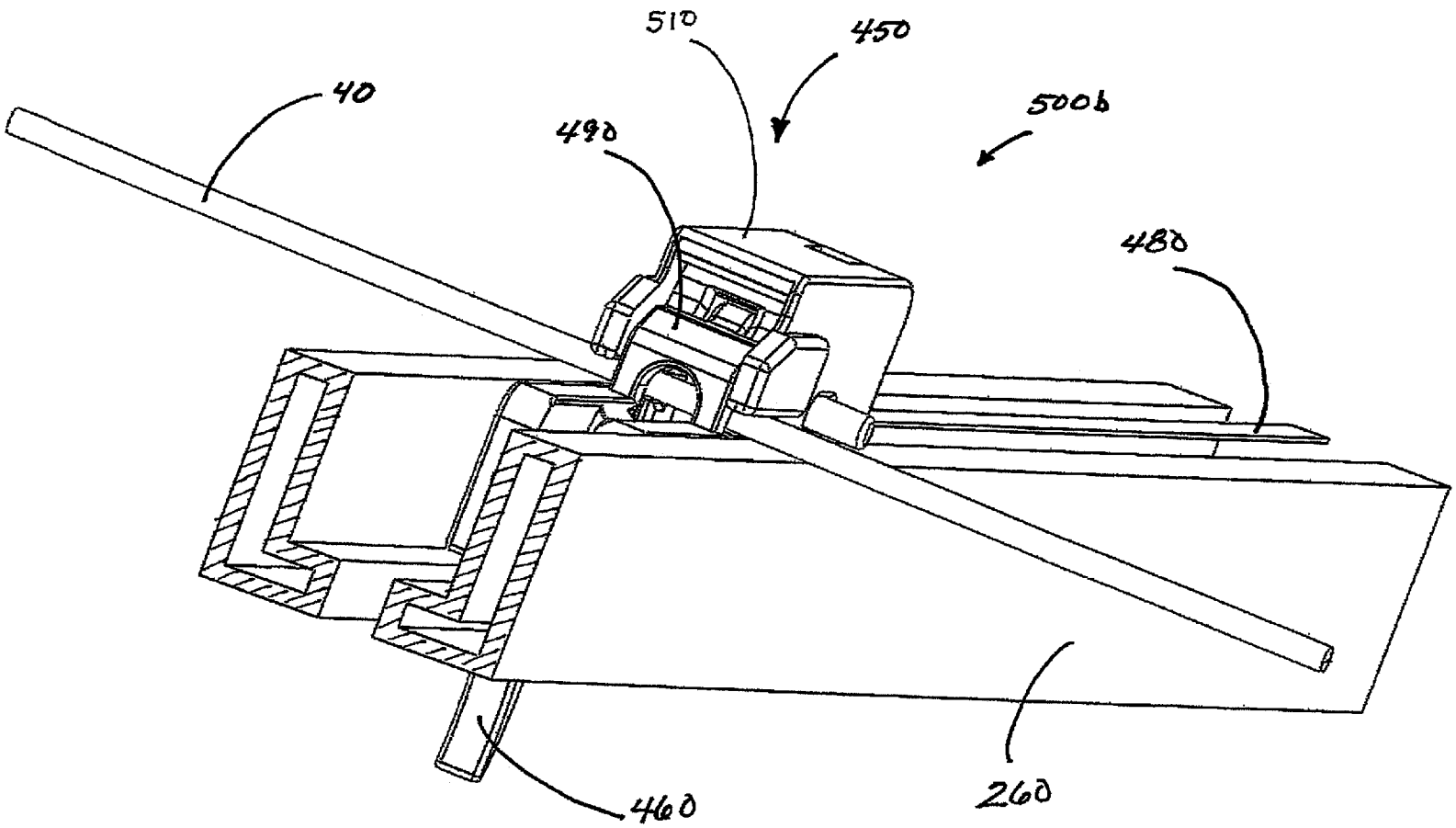
FIG. 14 is a view of a partial view of a moving latch housing with a trigger arm coupled to the moving latch housing, the moving latch housing is being moved by a strap and retained by an elongated frame members wherein the moving latch assembly is retaining a bowstring of a crossbow of the present invention.
Figure 15:
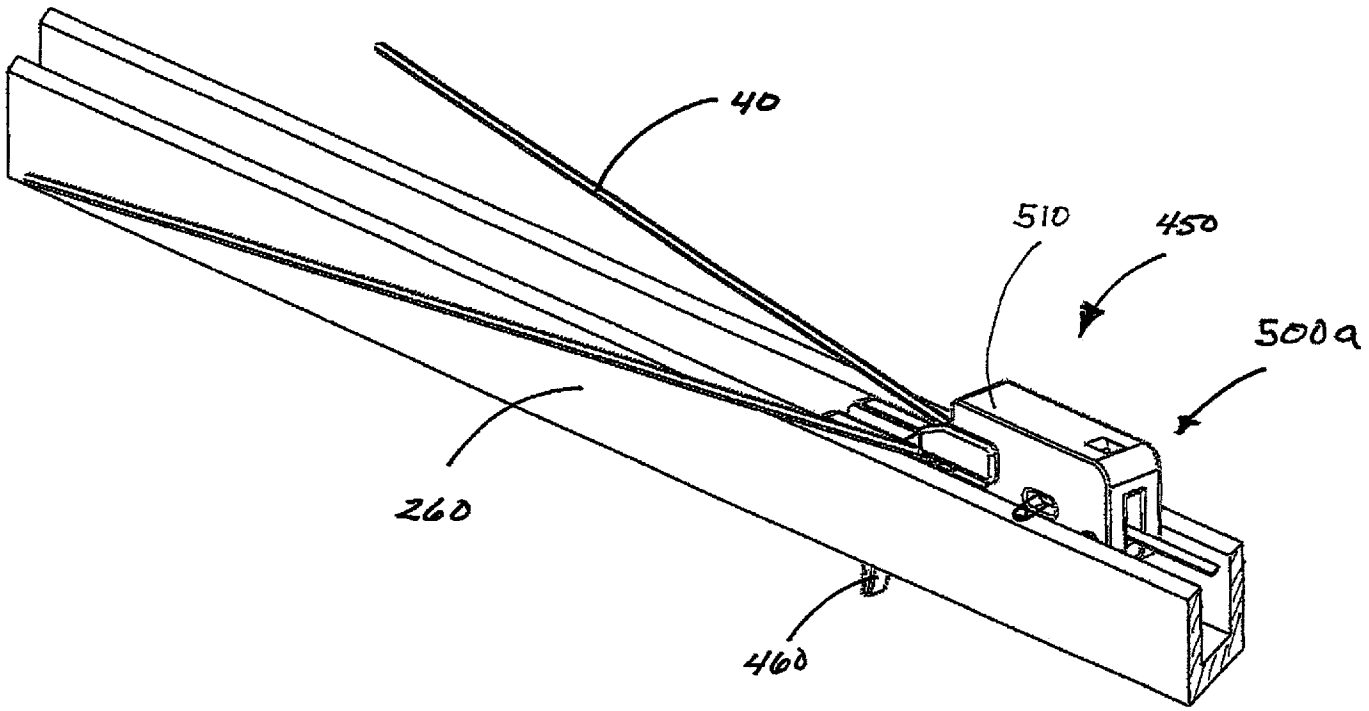
FIG. 15 is a view of a partial view of a moving latch housing with a trigger arm coupled to the moving latch housing, the moving latch housing is being moved by a strap and retained by an elongated frame members wherein the moving latch assembly is retaining a bowstring of a crossbow in a cocked or drawn position of the present invention.

Unique to the present invention and shown in FIGS. 10-15 is a movable trigger assembly with trigger arm 450 movable by any means from a first position 500*a* to a second position 500*b*, and back to a first position 500*a*, wherein the movable trigger assembly with trigger arm 450 is a complete self-contained assembly non reliant on external couplings or associations to release said launch string of the crossbow once the crossbow is cocked, in that the trigger 460 is directly coupled to and travels with the moving trigger housing 510. The moving trigger assembly with trigger arm 450 may be retained within an elongated member such as an extrusion 260, or guided by tubes or rods 270, or other methods known in the art. The moving trigger assembly with trigger arm 450 allows the crossbow 1 to achieve maximum performance when said moving trigger assembly with trigger arm 450 is retracted to the said first position 500*a*. The present invention allows for the user to determine performance of the crossbow 1 by the location of said moving trigger assembly with trigger arm 450 in that the user may choose to fully retrieve said moving trigger assembly with trigger arm 450 to the first position 500*a*, or any position between the first position 500*a* and the second position 500*b*. An example of this would be a first position power stroke of 18 inches and arrow speed of 440 feet per second. The user may wish to limit arrow speed to 400 feet per second, and may retrieve said moving trigger assembly 16 inches from the at second position, or limit the speed of the arrow to 330 feet per second and may retrieve said moving trigger assembly 14 inches from said second position.

For this disclosure, a trigger 460 is a component that is coupled directly or indirectly with the sear lever 122, and selectively causes the sear lever 122 to disengage the latch 120, thus allowing the launch string 40 to be released from the latch 120.

An anti-dry fire device is a component that detects the presence of an arrow. When there is no arrow present, the anti-dry fire device is in a first position and blocks the sear from movement: when an arrow is present, the arrow moves the anti-dry fire to a second position, allowing movement of the sear lever.

A sear lever is a component that engages, directly or indirectly, with the trigger and the string latch. Said sear lever is pivotally retained in said housing, having a sear surface engaging with a sear surface on said string latch.

A string latch is a component pivotally retained in said housing, and engages with the sear lever via said sear surface, and selectively retains said launch string.

A moving trigger assembly is the assembly comprising the trigger and all associated components for function of a retainment and release mechanism for a crossbow.

Though the preferred embodiment of the present invention is disclosed, it in no way limits the scope of the Patent to the preferred disclosure. Alterations of design and alternatives to power sources may be incorporated to provide rotational forces and forwards and rear movement of a string engagement and retention means.

We claim:

1. A crossbow having a moving trigger assembly for selectively retaining and selectively releasing the bowstring of a crossbow, said moving trigger assembly includes a housing, a string latch, a sear lever, and a trigger arm, said string latch is retained in said housing to releasably capture the bowstring, said sear lever and said trigger arm are used to release said string latch, said trigger arm is pivotally retrained in said housing, and moves with said housing, a device for moving said moving trigger assembly from a ready to fire position to a latch a bowstring position.

2. The moving trigger assembly of claim 1 wherein the said moving trigger housing is movable from a first position, also known as a proximal or ready to fire position, to a second position also known as distal or string at-rest position, at said second position said string latch retains said bowstring; said crossbow having any means known in the art provided to move said moving trigger assembly and said bowstring to said first position.

3. The moving trigger assembly of claim 1 wherein said safety is one of a manual safety and an automatic safety.

4. The moving trigger assembly of claim 1 wherein said moving trigger assembly has an anti-dryfire device.

5. The moving trigger assembly of claim 1 wherein the said moving trigger housing is movable from a first position, also known as a proximal or ready to fire position, to a second position also known as distal or string at-rest position, at said second position said string latch retains said bowstring; said crossbow having any means known in the art provided to move said moving trigger assembly and said bowstring to said first position, and said means selectable to move said moving trigger assembly and said bowstring from said first position to said second position.

6. The crossbow having a moving trigger assembly of claim 1, further comprising said moving trigger assembly travels in a U-shaped channel, a slot is formed through a bottom of said U-shaped channel to provide clearance for a trigger of said trigger arm.

7. The crossbow having a moving trigger assembly of claim 1, further comprising said moving trigger assembly is engaged with and slides along two parallel lengthwise tubes.

8. A crossbow having a moving trigger assembly for selectively retaining and selectively releasing the bowstring of a crossbow; said moving trigger assembly has a housing, a string latch, a sear lever, a safety, and a trigger arm; said trigger arm is pivotally retrained with said housing and moves with said housing, said moving trigger housing is movable from a first proximal position to a second distal position, said latch select-ably retains a bowstring, said crossbow having a means to move said moving trigger assembly and said bowstring from said distal position towards said proximal position, wherein said crossbow has a means to select-ably retain said moving trigger housing and said bowstring at any incremental position between said distal position and said proximal position.

9. The crossbow having a moving trigger assembly of claim 8 wherein the power stroke of said crossbow is selectable dependent to said incremental position.

10. The crossbow having a moving trigger assembly of claim 8, further comprising said moving trigger assembly travels in a U-shaped channel, a slot is formed through a bottom of said U-shaped channel to provide clearance for a trigger of said trigger arm.

11. The crossbow having a moving trigger assembly of claim 8, further comprising said moving trigger assembly is engaged with and slides along two parallel lengthwise tubes.

12. A crossbow having a moving trigger assembly for selectively retaining and selectively releasing the bowstring of a crossbow, said moving trigger assembly includes a housing, a string latch, a sear lever, a safety, and a trigger arm, said string latch is retained in said housing to releasably capture the bowstring, said sear lever and said trigger arm are used to release said string latch, said trigger arm is pivotally retrained in said housing, and moves with said housing, a device for moving said moving trigger assembly from a ready to fire position to a latch a bowstring position.

13. The crossbow having a moving trigger assembly of claim 12, further comprising said moving trigger assembly travels in a U-shaped channel, a slot is formed through a bottom of said U-shaped channel to provide clearance for a trigger of said trigger arm.

14. The crossbow having a moving trigger assembly of claim 12, comprising said moving trigger assembly is engaged with and slides along two parallel lengthwise tubes.

* * * * *